US007098765B2

(12) United States Patent
Fujiyama et al.

(10) Patent No.: US 7,098,765 B2
(45) Date of Patent: Aug. 29, 2006

(54) IGNITION COIL HAVING MAGNETIC FLUX REDUCING INNER STRUCTURE

(75) Inventors: Norihito Fujiyama, Obu (JP); Jyunichi Wada, Chita-gun (JP)

(73) Assignee: Denso Corporation, (JP)

( * ) Notice: Subject to any disclaimer, the term of this patent is extended or adjusted under 35 U.S.C. 154(b) by 179 days.

(21) Appl. No.: 10/987,093

(22) Filed: Nov. 15, 2004

(65) Prior Publication Data

US 2005/0110604 A1 May 26, 2005

(30) Foreign Application Priority Data

Nov. 26, 2003 (JP) ..... 2003-395990
Aug. 24, 2004 (JP) ..... 2004-244056

(51) Int. Cl.
*H01F 27/02* (2006.01)

(52) U.S. Cl. ..... 336/90

(58) Field of Classification Search ..... 336/65, 336/83, 90–96, 107, 192, 198; 123/634–635
See application file for complete search history.

(56) References Cited

U.S. PATENT DOCUMENTS 5,128,646 A * 7/1992 Suzuki et al. ..... 336/110
6,192,873 B1 * 2/2001 Adachi et al. ..... 123/635
6,337,617 B1 * 1/2002 Kato et al. ..... 336/96
6,525,636 B1 * 2/2003 Oosuka et al. ..... 336/90

FOREIGN PATENT DOCUMENTS

JP 3-136219 6/1991
JP 11-67563 3/1999

* cited by examiner

*Primary Examiner*—Tuyen T Nguyen
(74) *Attorney, Agent, or Firm*—Nixon & Vanderhye PC

(57) ABSTRACT

An ignition coil is constructed of a center core, a primary coil, a secondary coil, and an outer circumferential core. The center core and the outer circumferential core are connected with each other via a first magnetoresistive member on one axial end side. The center core and the outer circumferential core are connected with each other via a second magnetoresistive member on the other axial end side. A permanent magnet is arranged in an axially central portion of the center core. A magnetic passage is formed of the center core, the permanent magnet, the first magnetoresistive member, the outer circumferential core, and the second magnetoresistive member. Magnetic flux generated by the primary coil is reduced through the first and second magnetoresistive members, and is reverse-biased by the permanent magnet.

4 Claims, 9 Drawing Sheets

IGNITION COIL HAVING MAGNETIC FLUX REDUCING INNER STRUCTURE

CROSS REFERENCE TO RELATED APPLICATIONS

This application is based on and incorporates herein by reference Japanese Patent Applications No. 2003-395990 filed on Nov. 26, 2003 and No. 2004-244056 filed on Aug. 24, 2004.

FIELD OF THE INVENTION

The present invention relates to an ignition coil.

BACKGROUND OF THE INVENTION

According to JP-A-3-136219, a conventional ignition coil generates high voltage electric power, and the high voltage electric power is supplied to an ignition plug via a mechanical distributor and a high-tension cord. Presently, ignition coils are individually provided to cylinders of an internal combustion engine to directly supply high voltage power to ignition plugs. When the diameter of an ignition plug is reduced, the cross-sectional area of an engine water jacket arranged around an ignition plug can be increased, so that cooling efficiency of the engine can be enhanced. Therefore, the diameter of an ignition plug needs to be reduced in order to enhance fuel efficiency of a vehicle and to enhance engine power.

According to JP-A-3-136219, the conventional ignition coil has a structure, in which output electric power can be enhanced without jumboizing. That is, an ignition coil can be small sized applying the structure of the ignition coil, when output voltage is the same. The ignition coil includes a core, a permanent magnet, a primary bobbin, a secondary bobbin and a case. The core partially forms a closed magnetic passage, in which the permanent magnet is provided. A primary coil is wound on the primary bobbin. A secondary coil is wound on the secondary bobbin. The case receives the above components. The core is constructed of a first core and a second core that are made of silicon steel plates. The first core has a T-shaped cross-section, and the second core has an E-shaped cross-section in the radial direction. The permanent magnet is arranged between a radially central protrusion of the first core and a radially central protrusion of the second core to generate magnetic flux in an opposite direction as magnetic flux generated by the first coil. That is, magnetic flux generated by the first coil is reverse-biased by the magnetic flux generated by the permanent magnet. Therefore, magnetic flux passing through the closed magnetic passage is reduced by magnetic flux generated by the permanent magnet. However in this structure, magnetic flux generated by the primary coil does not change, and voltage induced in the secondary coil, i.e., output voltage of the secondary coil does not change. Accordingly, magnetic saturation can be avoided even the cross-sectional area of the closed magnetic passage is reduced. As a result, the diameter of the closed magnetic passage (magnetic circuit) can be reduced, while maintaining output voltage.

However, magnetic flux generated by the primary coil is substantially large in the ignition coil. By contrast, magnetic flux generated by the permanent magnet for reverse biasing in the magnetic passage is limited. Magnetic flux generated by the permanent magnet cannot be easily increased, because magnetic property of the permanent magnet cannot be easily enhanced and the size of the permanent magnet is limited. Accordingly, magnetic flux passing through the closed magnetic passage cannot be sufficiently reverse-biased for reducing the magnetic flux, and the ignition coil is difficult to be small sized.

SUMMARY OF THE INVENTION

In view of the foregoing problems, it is an object of the present invention to produce an ignition coil that can be small sized while maintaining an ignition performance.

According to the present invention, an ignition coil includes a center core, a primary coil, a secondary coil, an outer circumferential core, at least one high magnetoresistive member, and at least one permanent magnet.

The center core is made of a magnetic material. The center core defines a magnetic passage. The primary coil is coaxially wound on the outer circumferential side of the center core. The secondary coil is wound coaxially with respect to the primary coil. The outer circumferential core is coaxially arranged on the outer circumferential side of both the primary coil and the secondary coil. The outer circumferential core is formed of a magnetic material. The outer circumferential core defines a magnetic passage.

Each high magnetoresistive member is arranged between an axially outer end portion of the center core and an axially outer end portion of the outer circumferential core on the axially same side. The high magnetoresistive member has a magnetic resistance higher than a magnetic resistance of the center core and a magnetic resistance of the outer circumferential core. Each permanent magnet is located in an axially intermediate portion of the center core, such that the permanent magnet is apart from an axially outer end face of the center core by a distance, which is equal to or greater than 20% of an axial length of the center core and is equal to or less than 80% of the axial length of the center core. The at least one permanent magnet generates magnetic flux in a direction that is opposite to a direction, in which the primary coil generates magnetic flux.

Alternatively, the ignition coil includes at least one axial end magnet, instead of the high magnetoresistive member. The at least one axial end magnet is arranged on at least one of axial end portions of the center core. The at least one axial end magnet generates magnetic flux in a direction, which is opposite as a direction, in which the primary coil generates magnetic flux. The at least one center magnet that is located between both axially adjacent axial end portions of the center core, such that the at least one center magnet generates magnetic flux in a direction, which is opposite as a direction, in which the primary coil generates magnetic flux.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
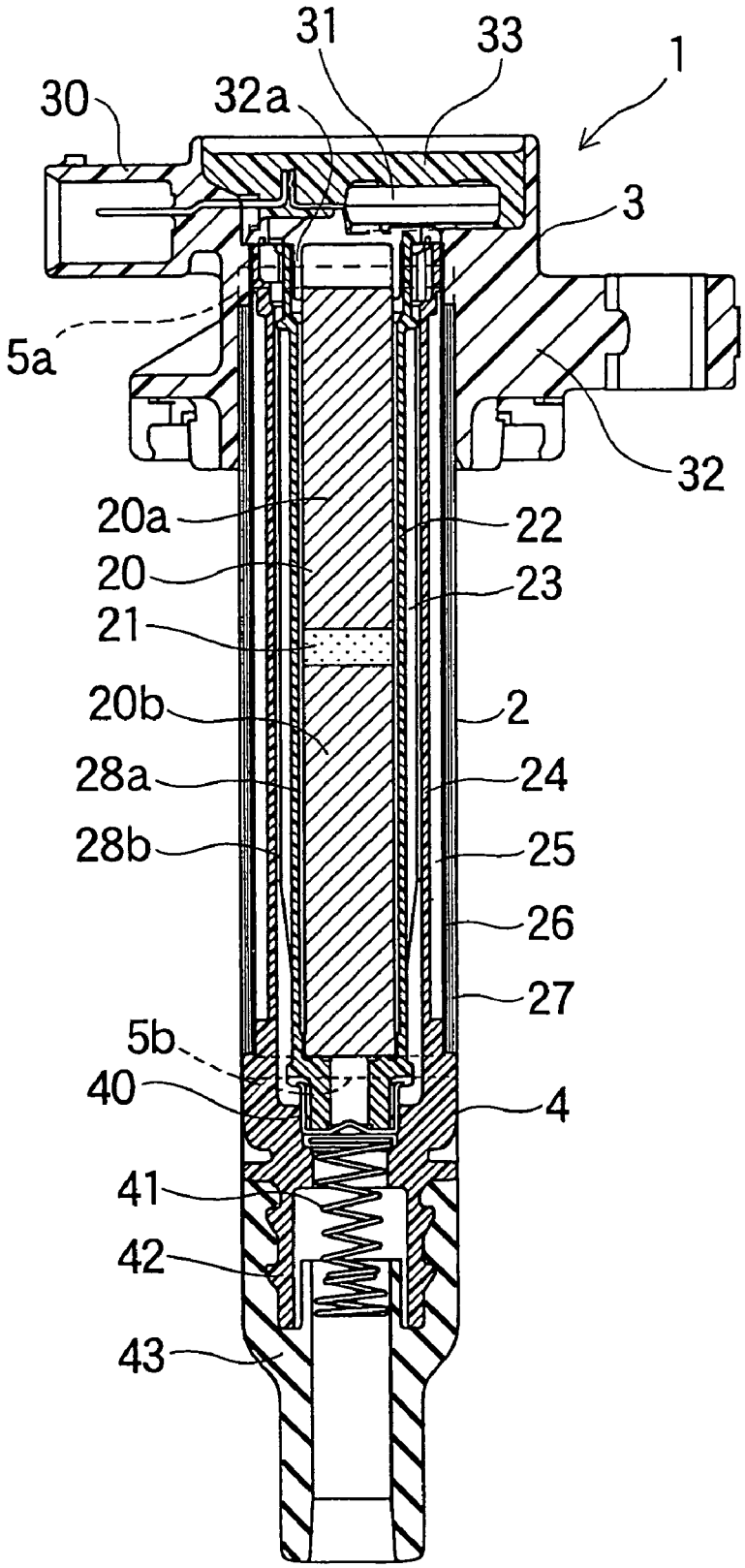
FIG. 1 is a cross-sectional side view showing an ignition coil according to a first embodiment of the present invention.

As shown in FIG. 1, an ignition coil 1 includes a center core 20, a coil portion 2, a connector portion 3 and a high voltage tower portion 4. The coil portion 2 is constructed of a permanent magnet 21, a secondary spool 22, a secondary coil 23, a primary spool 24, a primary coil 25, a tube 26, and an outer circumferential core 27. The ignition coil 1 supplies high voltage electric power to an ignition plug of a vehicular internal combustion engine. The ignition coil 1 is directly mounted to a plughole of a cylinder of the engine.

The center core 20 is constructed of a first center core 20*a* and a second center core 20*b*. Each of the first and second center cores 20*a*, 20*b* is constructed of multiple rectangular silicon steel plates, which respectively have different widths. The rectangular silicon steel plates are stacked to be in a substantially column shape. Each of the first and second center cores 20*a*, 20*b* has the same axial length, and has the same outer diameter that is set at 8 mm. The permanent magnet 21 is made of a rare earth material, and is formed in a column shape. Both axial ends of the permanent magnet 21 are magnetized. The permanent magnet 21 has an axial length, which is set at 0.5 mm, and has an outer diameter that is set at 8 mm as same as the outer diameter of the center core 20. Both axial end faces, i.e., magnetic pole faces of the permanent magnet 21 are inserted between one axial end face of the first center core 20*a* and one axial end face of the second center core 20*b*. The permanent magnet 21 is apart from an axial end face of the center core 20 by 50% of the axial length of the center core 20. The permanent magnet 21 generates magnetic flux in an opposite direction as a direction, in which a primary coil 25 generates magnetic flux.

The secondary spool 22 is a resinous bottomed cylindrical member that is constructed of a cylindrical portion and a bottom portion. The bottom portion of the secondary spool 22 radially internally extends from one axial end portion of the cylindrical portion.

The center core 20, which axially inserts the permanent magnet 21 therein, is arranged in a space surrounded by the cylindrical portion of the secondary spool 22. An insulating member 28*a* is arranged between the secondary spool 22 and the center core 20 to electrically insulate the secondary spool 22 and the center core 20. The secondary coil 23 is a winding wire that is wound on the outer circumferential periphery of the secondary spool 22.

The primary spool 24 is a resinous bottomed cylindrical member that is coaxially arranged on the outer circumferential side of the secondary coil 23. An insulating member 28*b* is arranged between the primary spool 24 and the secondary coil 23 to electrically insulate between the primary spool 24 and the secondary coil 23. The primary coil 25 is a winding wire that is wound on the outer circumferential periphery of the primary spool 24 by 220 to 300 turns.

The tube 26 is a resinous cylindrical member that is coaxially arranged on the outer circumferential side of the primary coil 25. The tube 26 protects the primary coil 25, and electrically insulates between the primary coil 25 and an outer circumferential core 27. The outer circumferential core 27 is formed in a manner that a silicon steel plate is rolled to be in a cylindrical member. The outer circumferential core 27 is coaxially arranged on the outer circumferential side of the primary coil 25 that is circumferentially protected by the tube 26.

The connector portion 3 is arranged on the upper side of the coil portion 2 in FIG. 1, and the connector portion 3 includes a connector 30, an igniter 31 and a connector case 32. The connector 30 is an electric device for supplying an ignition-timing signal transmitted from an ECU (electronic control unit, not shown) to an igniter 31 that is electrically connected with the connector 30 and the primary coil 25. The igniter 31 controls primary current, which is supplied to the primary coil 25, in accordance with the ignition-timing signal transmitted from the ECU via the connector 30. The connector case 32 is a resinous bottomed cylindrical member that is constructed of a cylindrical portion, a bottom portion and a cylindrical rib 32*a*. The bottom portion of the connector case 32 radially extends internally from the inner circumferential periphery of the cylindrical portion. The cylindrical rib 32*a* axially extends internally from the bottom portion of the connector case 32.

The coil portion 2 is inserted into the inner circumferential periphery of the cylindrical portion of the connector case 32 from the opening side of the connector case 32 that is axially opposite as the bottom portion of the connector case 32. The coil portion 2 is pressed into the inner circumferential periphery of the cylindrical portion of the connector case 32 and secured to the connector case 32. The rib 32*a* of the connector case 32 is circumferentially inserted between the center core 20 and the secondary spool 22, while forming a space.

The igniter 31 is received in a space formed in the cylindrical portion of the connector case 32 on the axially opposite side as the opening side of the connector case 32. Epoxy resin is filled in the space receiving the igniter 31. The connector 30 is arranged in the outer circumferential periphery of the connector case 32 such that the connector 30 is oriented in the radially outer side.

The high voltage tower portion 4 is arranged on the lower side of the coil portion 2 in FIG. 1. The high voltage tower portion 4 is constructed of a terminal plate 40, a spring 41, a high voltage tower case 42 and a plug cap 43. The terminal plate 40 is a metallic cup-shaped member. The inner circumferential periphery of the terminal plate 40 fits to the outer circumferential periphery of the axially end portion of the secondary spool 22, so that the terminal plate 40 is secured to the secondary spool 22. The terminal plate 40 is electrically connected with a high voltage output terminal of the secondary coil 23. The spring 41 is a metallic spiral-shaped member. One axial end of the spring 41 is electrically connected with the terminal plate 40, and the other axial end of the spring 41 fits to an ignition plug (not shown). The high voltage tower case 42 is a resinous cylindrical member that is integrally formed with the primary spool 24. The terminal plate 40 and the spring 41 are received in the high voltage tower case 42. The plug cap 43 is a rubber cylindrical member that fits to one end portion of the high voltage tower case 42. The ignition plug is supported by the inner circumferential periphery of the plug cap 43.

Figure 2:
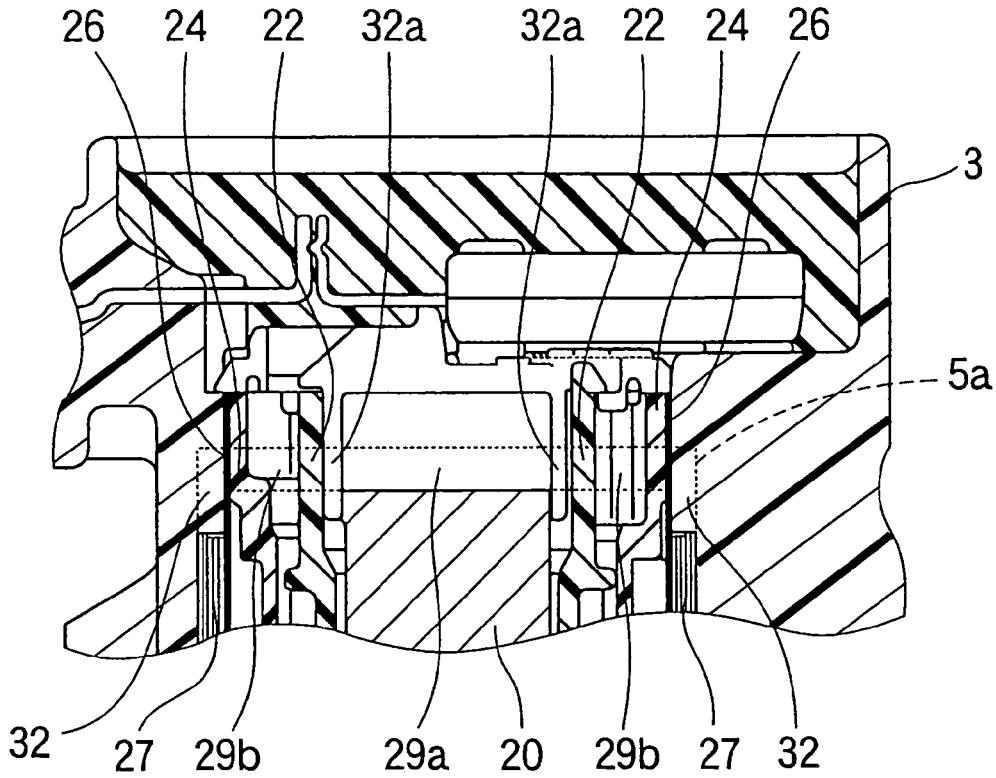
FIG. 2 is an enlarged partially cross-sectional side view showing one axially end portion of a center core of the ignition coil according to the first embodiment.

As shown in FIG. 2, one axially end portion of the center core 20 on the side of the connector portion 3 and one axially end portion of the outer circumferential core 27 are connected via a first high magnetoresistive member (first magnetoresistive member) 5*a*. That is, the first magnetoresistive member 5*a* is located radially between the one axially end portion of the center core 20 on the side of the connector portion 3 and the one axially end portion of the outer circumferential core 27.

The first magnetoresistive member 5*a* is constructed of the rib 32*a* of the connector case 32, the secondary spool 22, the primary spool 24, the tube 26, and the connector case 32. A cylindrical space 29*a* is formed radially adjacent to the axially end portion of the center core 20 on the upper side in FIG. 2. The rib 32*a* of the connector case 32 is coaxially arranged on the radially outer side of the cylindrical space 29*a*. A space 29*b* is formed between the secondary spool 22 and the primary spool 24. That is, the first magnetoresistive member 5*a* includes non-magnetic members and air spaces such as the cylindrical space 29*a*, the rib 32*a* of the connector case 32, the secondary spool 22, the space 29*b*, the primary spool 24, the tube 26, and the connector case 32. The first magnetoresistive member 5*a* is constructed of non-magnetic members as described above, so that the first magnetoresistive member 5*a* has a high magnetic resistance.

Figure 3:
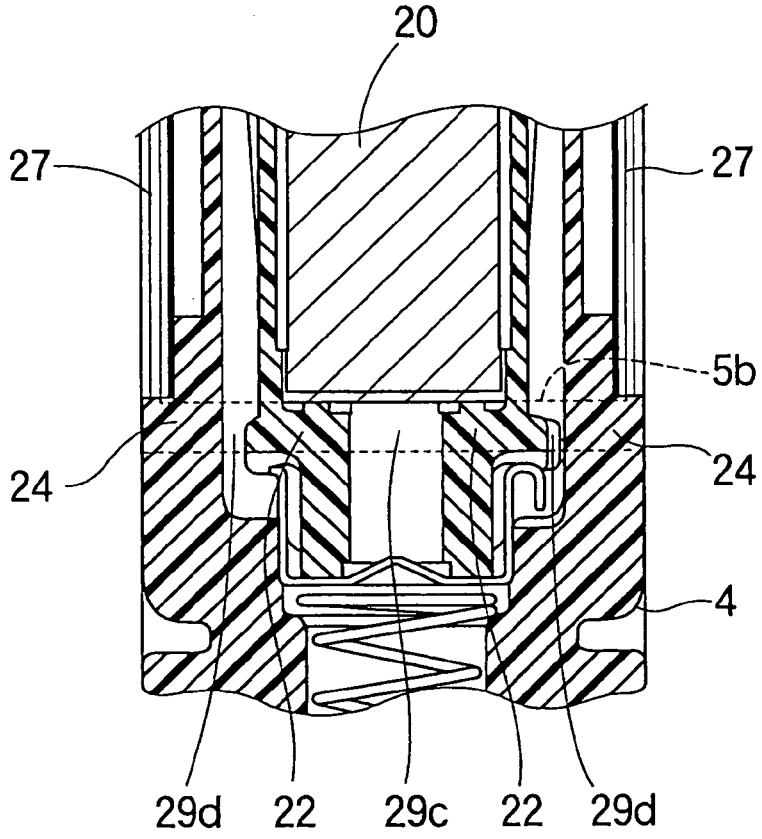
FIG. 3 is an enlarged partially cross-sectional side view showing the other axially end portion of the center core of the ignition coil according to the first embodiment.

As shown in FIG. 3, the axially end portion of the center core 20 on the side of the high voltage tower portion 4 and the axially end portion of the outer circumferential core 27 on the lower side in FIG. 3 are connected with each other via a second high magnetoresistive member (second magnetoresistive member) 5*b*. That is, the second magnetoresistive member 5*b* is located radially between the axially end portion of the center core 20 and the axially end portion of the outer circumferential core 27 on the lower side in FIG. 3.

The second magnetoresistive member 5*b* is constructed of the secondary spool 22 and the primary spool 24. A cylindrical space (cylindrical air space) 29*c* is formed axially adjacent to the axial end of the center core 20 on the lower side in FIG. 3. The secondary spool 22 is coaxially arranged on the outer circumferential side of the cylindrical space 29*c*. The secondary spool 22 and the primary spool 24 form a cylindrical space (cylindrical air space) 29*d* therebetween. That is, the second magnetoresistive member 5*b* includes non-magnetic members and air spaces such as the cylindrical space 29*c*, the secondary spool 22, the cylindrical space 29*d* and the primary spool 24. The second magnetoresistive member 5*b* has a magnetic resistance higher than a magnetic resistance of a magnetic member, as well as the first magnetoresistive member 5*a*.

Next, an operation of the ignition coil 1 is described.

An ignition-timing signal is transmitted from the ECU into the igniter 31 in the connector portion 3 via the connector 30. The igniter 31 supplies primary current to the primary coil 25 in accordance with the ignition-timing signal. The primary current passes through the primary coil 25, so that the primary coil 25 generates magnetic flux. The magnetic flux passes from the center core 20 to the outer circumferential core 27 via the first magnetoresistive member 5*a*. Subsequently, the magnetic flux passes from the outer circumferential core 27 to the center core 20 via the second magnetoresistive member 5*b*. In this situation, the magnetic flux generated by the primary coil 25 is reduced by passing through the first magnetoresistive member 5*a* and the second magnetoresistive member 5*b*. Besides, the magnetic flux generated by the primary coil 25 is reverse-biased by magnetic flux generated by the permanent magnet 21 arranged in the axially center of the center core 20.

Magnetic flux passes through the magnetic passage that is constructed of the center core 20, the permanent magnet 21, the first magnetoresistive member 5*a*, the outer circumferential core 27, and the second magnetoresistive member 5*b*. Magnetic flux generated by the primary coil 25 interlinks the primary coil 25 with the secondary coil 23. The magnetic flux is reduced in the magnetic passage by passing through the high magnetoresistive members such as the first and second magnetoresistive members 5*a*, 5*b*. Therefore, the magnetic flux passing through the magnetic passage, which includes the first and second magnetoresistive members 5*a*, 5*b* and the permanent magnet 21, becomes smaller than magnetic flux passing through a magnetic passage, which is entirely formed of a magnetic member and excluding the permanent magnet 21. In this structure, energy accumulated in the primary coil 25 may be reduced. However, a number of winding of the primary coil 25 can be increased, so that reduction of the energy accumulated in the primary coil 25 can be compensated. Therefore, high voltage can be sufficiently induced in the secondary coil 23.

Here, one connecting terminal of the secondary coil 23 on the side of the connector portion 3 is grounded to the vehicular body. The other connecting terminal of the secondary coil 23 is connected to the terminal plate 40. Negative voltage such as −30 kV is generated with respect to the vehicular body on the other connecting terminal of the secondary coil 23. The high voltage is applied from the terminal plate 40 to the ignition plug via the spring 41. Thus, the ignition plug sparks in a gap between its terminals (not shown).

Effect of the ignition coil 1 is described in detail.

Magnetic resistance can be increased in the ignition coil 1 using the first and second magnetoresistive members 5*a*, 5*b*. Therefore, magnetic resistance can be increased in the magnetic passage, so that magnetic flux generated by the primary coil 25 can be reduced. Furthermore, magnetic flux generated by the primary coil 25 is reverse-biased by magnetic flux generated by the permanent magnet 21, so that the magnetic flux passing through the magnetic passage can be further reduced. As a result, magnetic flux passing through the magnetic passage can be sufficiently reduced, so that magnetic saturation can be avoided even a cross-sectional area of the magnetic passage is reduced. That is, the diameter of the ignition coil 1 can be reduced. Here, a number of winding of the primary coil 25 is increased, so that decrease of magnetic flux generated by the primary coil 25 can be compensated.

In this structure, magnetic resistance in the magnetic passage can be increased using the magnetoresistive members 5*a*, 5*b*. Besides, magnetic flux generated by the primary coil 25 can be reverse-biased using the permanent magnet 21. Magnetic flux generated by the primary coil 25 is inversely proportional to magnetic resistance in the magnetic passage. Therefore, magnetic resistance in a magnetic passage is increased using the magnetoresistive members 5*a*, 5*b*, so that magnetic flux generated by the primary coil 25 can be effectively reduced. Magnetic flux generated by the primary coil 25 is reverse biased using the permanent magnet 21, so that magnetic flux passing through the magnetic passage can be further reduced.

Energy accumulated in the primary coil 25 is proportional to magnetomotive force of the primary coil 25 and magnetic flux generated by the primary coil 25. Magnetomotive force of the primary coil 25 is proportional to the number of winding of the primary coil 25 and current passing through the primary coil 25. Therefore, decrease of magnetic flux generated by the primary coil 25 is compensated by increasing the number of winding of the primary coil 25, so that output voltage can be maintained.

The outer diameter of the ignition coil 1 may become large due to increase of the winding of the primary coil 25. However, increasing degree of the outer diameter of the ignition coil 1 due to additional winding of the primary coil 25 is much smaller than decreasing degree of the diameter of the ignition coil 1 that is achieved by reduction of the cross-sectional area of the magnetic passage. Therefore, the additional winding of the primary coil 25 does not badly affect to the reduction of the ignition coil 1 in the diameter.

The permanent magnet 21 is arranged in the axial center of the center core 20 in the ignition coil 1, so that leakage of magnetic flux of the permanent magnet 21 can be reduced compared with a structure, in which the permanent magnet 21 is arranged on an axially end side of the center core 20. Therefore, the magnetic passage can be efficiently reverse-biased, so that magnetic flux passing through the magnetic passage can be steadily reduced, and the ignition coil 1 can be further reduced in diameter.

Furthermore, the axial length of the permanent magnet 21 is set to be 0.5 mm in the ignition coil 1, so that strength can be sufficiently secured for vehicle use. Besides, the magnetic passage can be efficiently reverse-biased, while an amount of a magnetic material needed for producing the permanent magnet 21 is reduced. Thus, magnetic flux passing through the magnetic passage can be reduced, so that the ignition coil 1 can be reduced in diameter. Besides, an amount of a magnetic material for the permanent magnet 21 is reduced, so that the small-sized ignition coil 1 can be produced at a low cost.

Multiple permanent magnets can be inserted among multiple center cores divided into multiple pieces, instead of the above structure in which one permanent magnet 21 is inserted between axial end faces of the first and second center cores 20*a*, 20*b*.

The permanent magnet 21 is not limited to be arranged in the axial center of the center core 20 in the ignition coil 1. Leakage of magnetic flux of the permanent magnet 21 can be sufficiently reduced, when the permanent magnet 21 is arranged in a longitudinal range between 20% of the axial length of the center core 20 and 80% of the axial length of the center core 20 from an axial end face of the center core 20.

The axial length of the permanent magnet 21, i.e., thickness of the permanent magnet 21 between the opposing magnetic poles in an axis of magnetic poles is not limited to 0.5 mm. When the thickness of the permanent magnet 21 is greater than 0.5 mm, mechanical strength of the permanent magnet 21 can be further enhanced. However, the thickness of the permanent magnet 21 is preferably set between 0.35 mm and 4 mm in consideration of its cost and magnetic flux, which is generated by the permanent magnet 21 to reverse bias magnetic flux in the magnetic passage.

The structure of the first and second magnetoresistive members 5*a*, 5*b* is not limited to the above structure. The cylindrical space 29*a* may be filled with a member such as a sponge that is capable of reducing axial thermal stress and restricting reduction of magnetic property of the center core 20. Furthermore, the spaces 29*b*, 29*c*, 29*d* may be filled with epoxy resin that is capable of bonding among the center core 20, the secondary spool 22 and the primary spool 24. The first and second magnetoresistive members 5*a*, 5*b*, which have magnetic resistance higher than that of a magnetic member, can be constructed using such non-magnetic materials.

Second Embodiment

Figure 4:
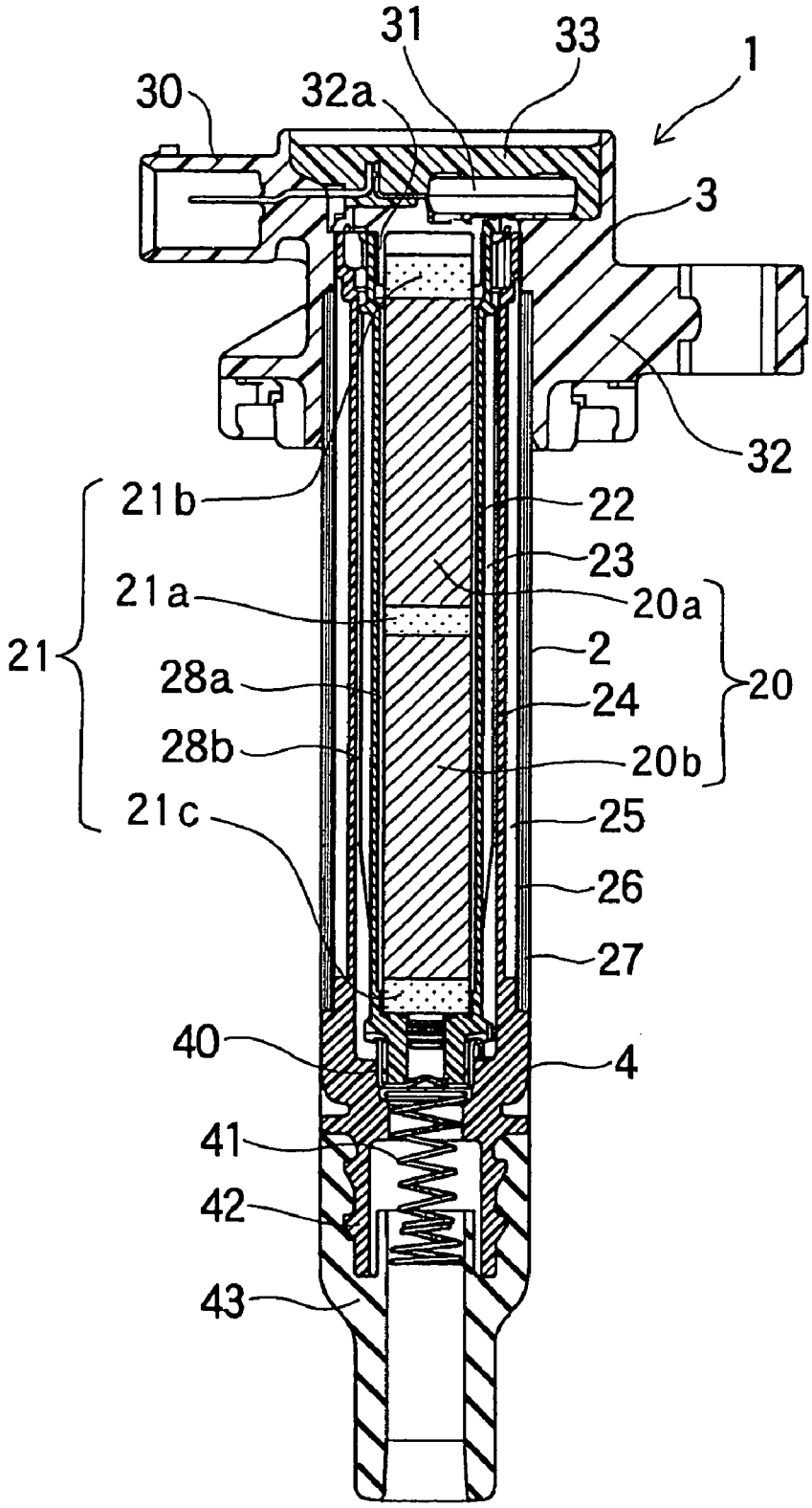
FIG. 4 is a cross-sectional side view showing an ignition coil according to a second embodiment of the present invention.

As shown in FIG. 4, the coil portion 2 is constructed of center cores 20, permanent magnets 21, the secondary spool 22, the secondary coil 23, the primary spool 24, the primary coil 25, the tube 26, and the outer circumferential core 27.

The center cores 20 include a first center core 20*a* and a second center core 20*b*. Each of the first and second center cores 20*a*, 20*b* is constructed of multiple rectangular silicon steel plates, which respectively have different widths. The rectangular silicon steel plates are stacked to be in a substantially column shape. Each of the first and second center cores 20*a*, 20*b* has axial length, such as 80 mm, and has an outer diameter such as 8 mm. The permanent magnets 21 include a center magnet 21*a*, a first axial end magnet 21*b* and a second axial end magnet 21*c*. The center magnet 21*a*, the first and second axial end magnets 21*b*, 21*c* are made of a rare earth material, and are formed in a substantially column shape. Both axial ends of the center magnet 21*a*, both axial ends of the first and second axial end magnets 21*b*, 21*c* are magnetized. The center magnet 21*a* has an axial length such as 0.5 mm, and has an outer diameter such as 8 mm as same as the outer diameter of the center cores 20.

Each of the first and second axial end magnets 21*b*, 21*c* has axial length such as 5.4 mm. The axial length of each of the first and second axial end magnets 21*b*, 21*c* is respectively larger than the axial length of the center magnet 21*a*.

Each of the first and second axial end magnets 21*b*, 21*c* has outer diameter such as 8 mm as same as the outer diameter of the center cores 20.

Both axial end faces, i.e., magnetic pole faces of the center magnet 21*a* are inserted between one axial end face of the first center core 20*a* and one axial end face of the second center core 20*b*. One axial end face of the first axial end magnet 21*b* is adjacent to the other axial end face of the first center core 20*a* on the upper side in FIG. 4. One axial end face of the second axial end magnet 21*c* is adjacent to the other axial end face of the second center core 20*b* on the lower side in FIG. 4. The center magnet 21*a*, the first and second axial end magnets 21*b*, 21*c* respectively generate magnetic flux in an opposite direction as a direction, in which the primary coil 25 generates magnetic flux.

Figure 5:
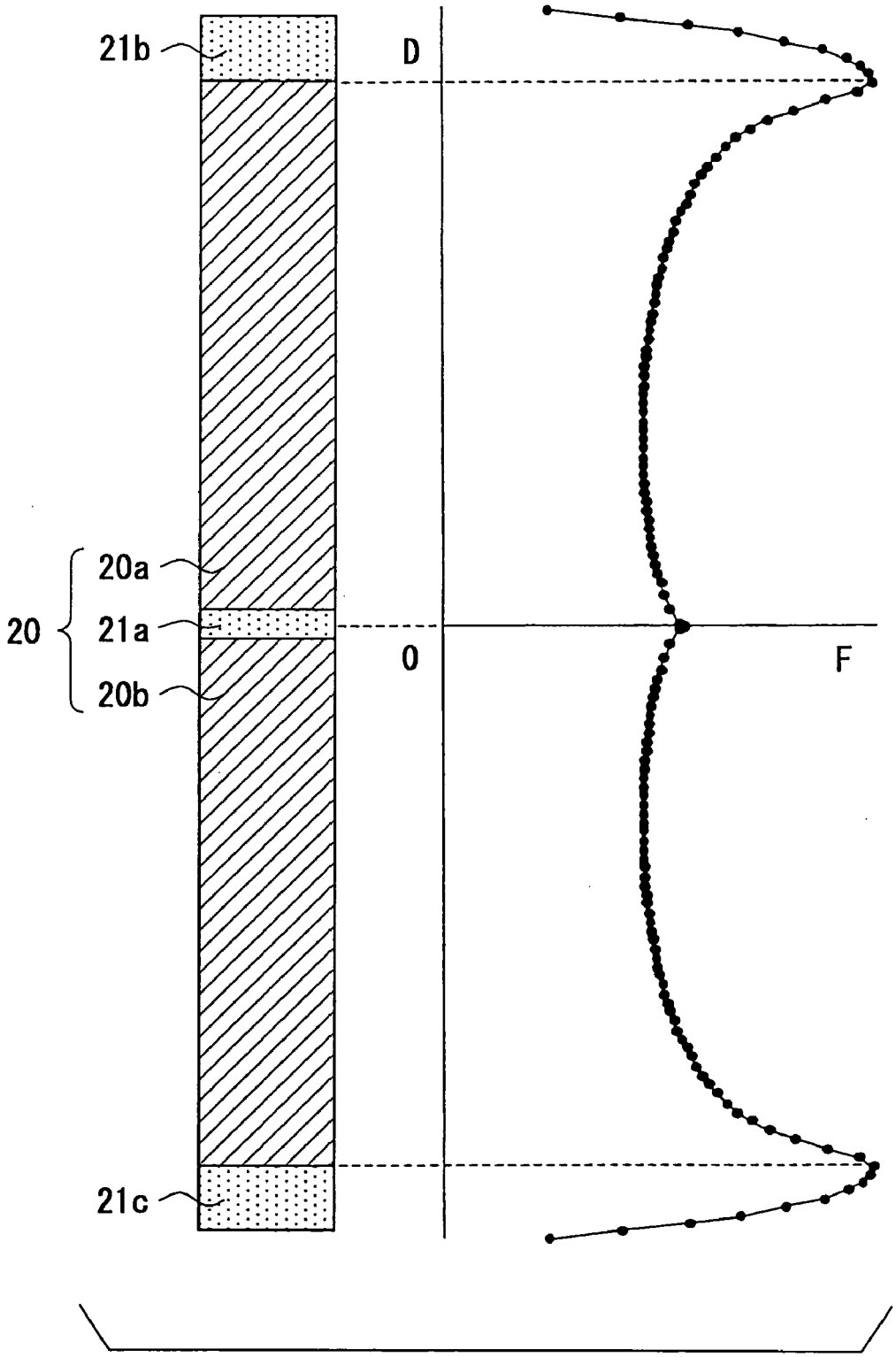
FIG. 5 is a graph showing a relationship between magnetic flux F and distance D from a center magnet according to the second embodiment.

As shown in FIG. 5, magnetic flux F passing through the center cores 20 is uniformly reverse-biased by magnetic flux generated by the center magnet 21*a*, the first and second axial end magnets 21*b*, 21*c*. The magnetic flux F becomes substantially uniform in the axial direction of the center cores 20 entirely over the distance D from the central magnet 21*a* in the central core 20.

Referring back to FIG. 4, the secondary spool 22 is a resinous bottomed cylindrical member that is constructed of a cylindrical portion and a bottom portion. The bottom portion radially internally extends from one axial end portion of the cylindrical portion.

The center cores 20 axially insert the center magnet 21*a* therein, and both axially outer end portions of the center cores 20 are adjacent to the first and second axial end magnets 21*b*, 21*c*. The center cores 20 are arranged in a space surrounded by the cylindrical portion of the secondary spool 22. An insulating member 28*a* is arranged between the secondary spool 22 and the center cores 20 to insulate therebetween. The secondary coil 23 is a winding wire that is wound on the outer circumferential periphery of the secondary spool 22.

The primary spool 24 is a resinous bottomed cylindrical member that is coaxially arranged on the outer circumferential side of the secondary coil 23. An insulating member 28*b* is arranged between the primary spool 24 and the secondary coil 23 to insulate therebetween. The primary coil 25 is a winding wire that is wound on the outer circumferential periphery of the primary spool 24.

The tube 26 is a resinous cylindrical member that is coaxially arranged on the outer circumferential side of the primary coil 25. The tube 26 protects the primary coil 25, and insulates between the primary coil 25 and the outer circumferential core 27. The outer circumferential core 27 is formed in a manner that a silicon steel plate is rolled to be in a cylindrical member. The outer circumferential core 27 is coaxially arranged on the outer circumferential side of the primary coil 25 that is circumferentially protected by the tube 26.

Next, an operation of the ignition coil 1 is described.

An ignition-timing signal is transmitted from the ECU into the igniter 31 in the connector portion 3 via the connector 30. The igniter 31 supplies primary current to the primary coil 25 in accordance with the ignition-timing signal. The primary current passes through the primary coil 25, so that the primary coil 25 generates magnetic flux.

The magnetic flux passes from the center cores 20 to the outer circumferential core 27 via the first axial end magnet 21*b*. Subsequently, the magnetic flux passes from the outer circumferential core 27 to the center cores 20 via the second axial end magnet 21*c*.

In this situation, the magnetic flux generated by the primary coil 25 is reverse-biased by axially substantially uniform magnetic flux generated by the center magnet 21*a*, the first and second axial end magnets 21*b*, 21*c* provided in the center cores 20. Thus, the magnetic flux passing through the center cores 20 is further reduced. The magnetic flux generated by the primary coil 25 interlinks the primary coil 25 with the secondary coil 23.

In this structure, magnetic flux passing through the center cores 20 is reverse-biased, however variation of magnetic flux, which induces electric voltage in the secondary coil 23, does not decrease. Therefore, high voltage power can be sufficiently induced in the secondary coil 23.

One connecting terminal of the secondary coil 23 on the side of the connector portion 3 is grounded to the vehicular body. The other connecting terminal of the secondary coil 23 is connected to the terminal plate 40. Negative voltage such as −30 kV is generated with respect to the vehicular body on the other connecting terminal of the secondary coil 23. The high voltage is applied from the terminal plate 40 to the ignition plug via the spring 41. Thus, the ignition plug sparks in a gap between its terminals (not shown).

Effect of the ignition coil 1 is described in detail.

Magnetic flux generated by the primary coil 25 is reverse-biased by magnetic flux generated by the center magnet 21*a*, the first and second axial end magnets 21*b*, 21*c*, so that the magnetic flux passing through the center cores 20 can be substantially uniformly reverse-biased in the axial direction of the center cores 20. As a result, magnetic flux passing through the center cores 20 can be further reduced, so that magnetic saturation can be avoided even a cross-sectional area of the center cores 20 is reduced. That is, the diameter of the ignition coil 1 can be reduced.

The axial length of the center magnet 21*a* is set to be 0.5 mm, so that the ignition coil 1 can steadily generate 30 mJ of secondary energy.

The axial lengths of the first and second center cores 20*a*, 20*b* are respectively set to be 80 mm. That is, the distance between the center magnet 21*a* and the first axial end magnet 21*b* is set to be 80 mm, and the distance between the center magnet 21*a* and the second axial end magnet 21*c* is also set to be 80 mm. Thus, magnetic flux can be sufficiently reverse-biased, and the axial length of the ignition coil 1 can be reduced.

Figure 6:
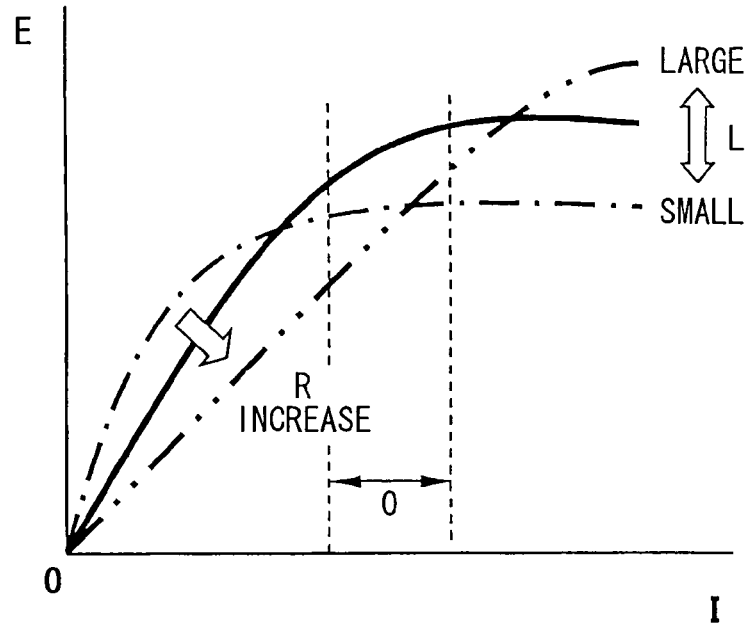
FIG. 6 is a graph showing a relationship between primary current I applied to the ignition coil and secondary energy E generated in the ignition coil, when the axial length L of the center magnet is changed, according to the second embodiment.

The axial length of the center magnet 21*a* is not limited to 0.5 mm. As shown in FIG. 6, when primary current I of the ignition coil is on the lower side with respect to an operating range O of the primary current I, as the axial length L of the center magnet becomes large, magnetic resistance R of the center magnet 21*a* increases as shown by the dashed line and the chain double-dashed line. As a result, secondary energy E of the ignition coil decreases. That is, secondary energy E, which can be supplied to the secondary side in the ignition coil, changes corresponding to the axial length L of the center magnet in the operating range O of the primary current I.

Figure 7:
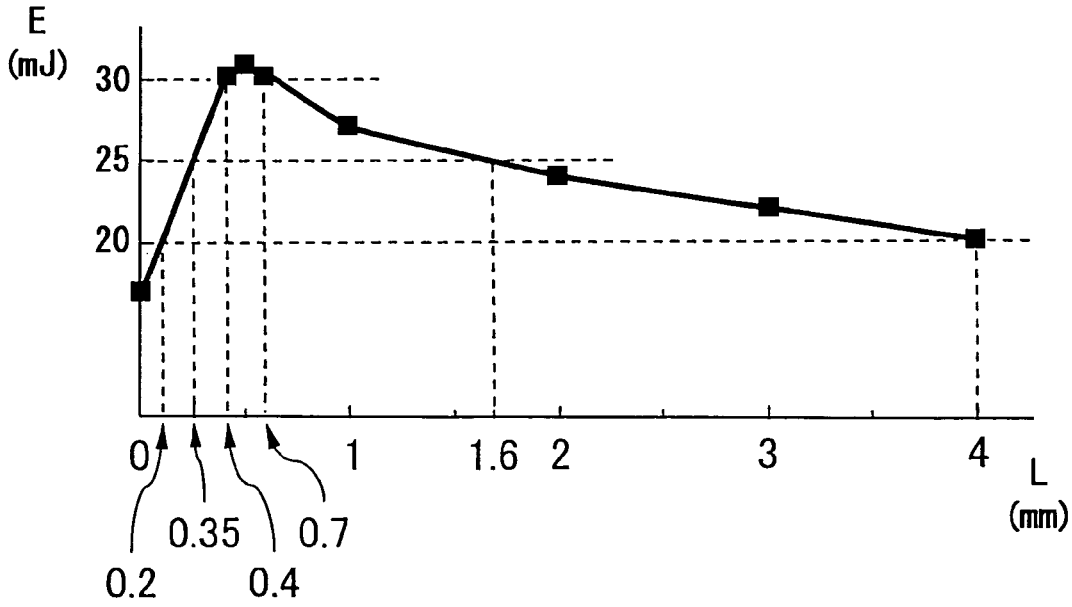
FIG. 7 is a graph showing a relationship between the axial length L of the center magnet and secondary energy E generated in the ignition coil according to the second embodiment.

Specifically as shown in FIG. 7, when secondary energy E needed for ignition is at least 20 mJ, the axial length L of the center magnet is preferably set to be between 0.2 mm and 4.0 mm. When secondary energy E needed for ignition is at least 25 mJ, the axial length L of the center magnet is preferably set to be between 0.35 mm and 1.6 mm. When secondary energy E needed for ignition is at least 30 mJ, the axial length L of the center magnet is preferably set to be between 0.4 mm and 0.7 mm.

Figure 8:
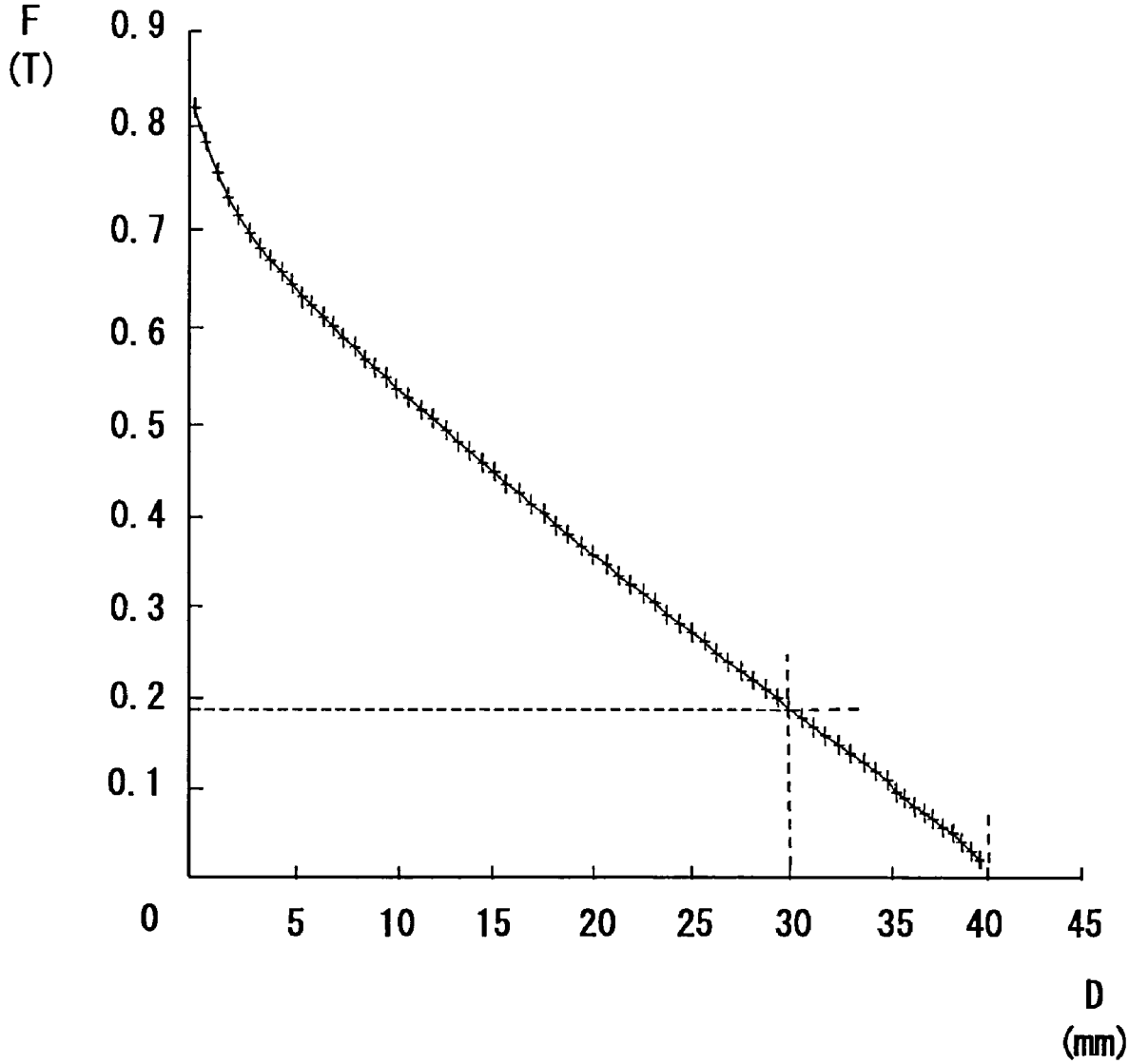
FIG. 8 is a graph showing a relationship between distance D from an axial end face of a magnet and magnetic flux F according to the second embodiment.

The axial lengths of the first and second center cores 20*a*, 20*b* are not limited to 80 mm. That is, the distance between the center magnet 21*a* and the first axial end magnet 21*b*, and the distances between the center magnet 21*a* and the second axial end magnet 21*c* are not limited to 80 mm. As shown in FIG. 8, magnetic flux F becomes substantially 0 T, when the distance D from the axial end face, i.e., magnetic pole face of the magnet exceeds 40 mm, and the magnet cannot sufficiently reverse bias the magnetic flux generated by the primary coil. Therefore, the distance between the center magnet 21*a* and the first axial end magnet 21*b*, and the distance between the center magnet 21*a* and the second axial end magnet 21*c* are preferably equal to or less than 80 mm that is twice as 40 mm. That is, the distances between adjacent magnets are preferably equal to or less than 80 mm. The distances between adjacent magnets are further preferably equal to or less than 60 mm that is twice as 30 mm to obtain larger reverse bias.

Here, one axial end magnet can be provided to either of the axial ends of the center cores 20, instead of the above structure, in which both first and second axial end magnets 21*b*, 21*c* are provided to both axial end sides of the center cores 20 including the center magnet 21*a* in its center portion.

Third Embodiment

Figure 9:
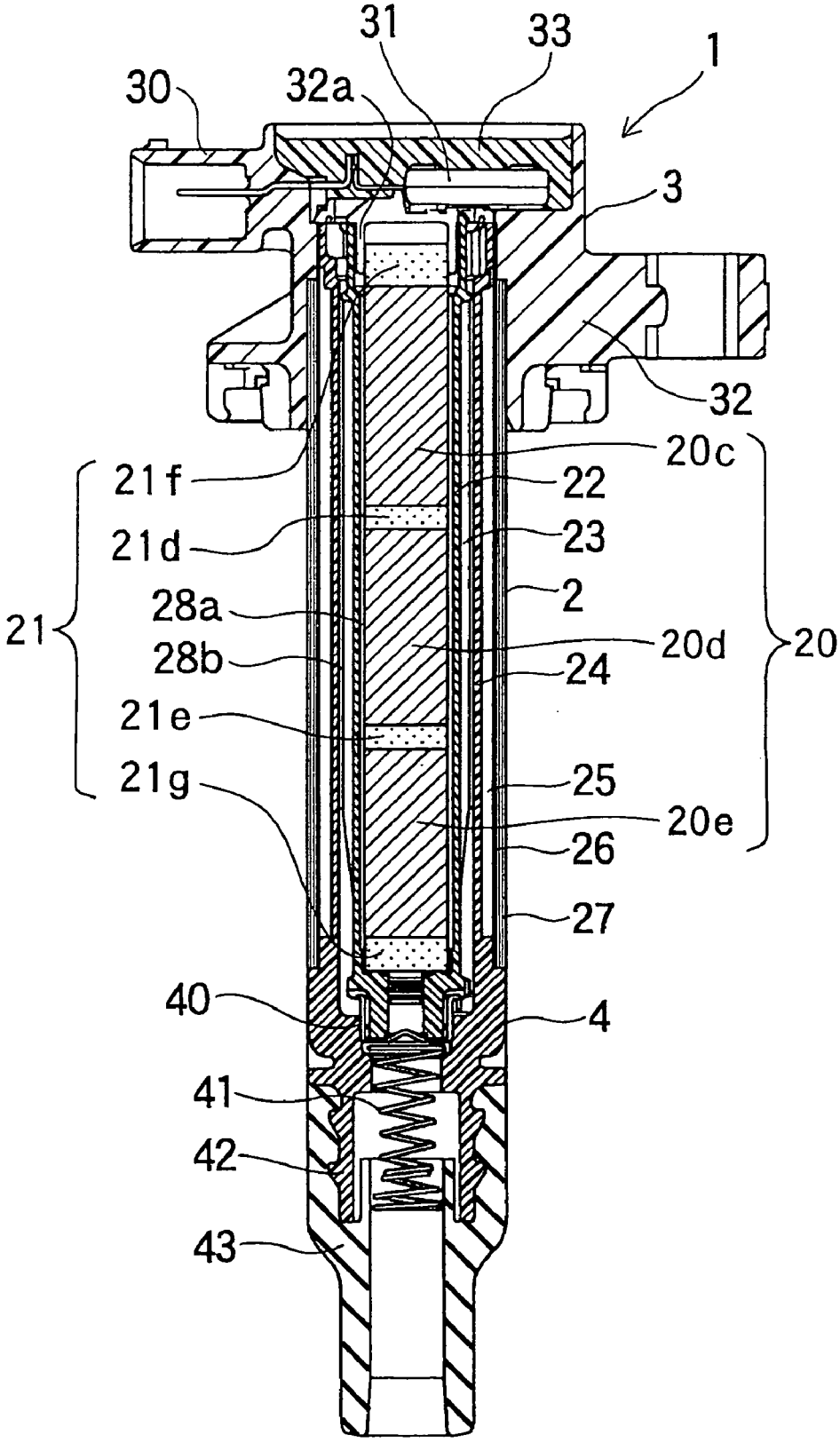
FIG. 9 is a cross-sectional side view showing an ignition coil according to a third embodiment of the present invention.

As shown in FIG. 9, the coil portion 2 is constructed of center cores 20, permanent magnets 21, the secondary spool 22, the secondary coil 23, the primary spool 24, the primary coil 25, the tube 26, and the outer circumferential core 27.

The center cores 20 include a first center core 20*c*, a second center core 20*d*, and a third center core 20*e*. Each of the first, second and third center cores 20*c*, 20*d*, 20*e* is constructed of multiple rectangular silicon steel plates, which respectively have different widths. The rectangular silicon steel plates are stacked to be in a substantially column shape. Each of the first, second and third center cores 20*c*, 20*d*, 20*e* has an axial length, such as 60 mm. Each of the first, second and third center cores 20*c*, 20*d*, 20*e* has an outer diameter, such as 4 mm. The permanent magnets 21 include a first center magnet 21*d*, a second center magnet 21*e*, a first axial end magnet 21*f* and a second axial end magnet 21*g*. The first and second center magnets 21*d*, 21*e*, the first and second axial end magnets 21*f*, 21*g* are made of a rare earth material, and are formed in a substantially column shape. Both axial ends of the first and second center magnets 21*d*, 21*e*, and both axial ends of the first and second axial end magnets 21*f*, 21*g* are magnetized. Each of the first and second center magnets 21*d*, 21*e* has an axial length such as 0.5 mm, and has an outer diameter such as 4 mm as same as the outer diameter of the center cores 20.

Each of the first and second axial end magnets 21*f*, 21*g* has axial length such as 5.4 mm. The length of the first and second axial end magnets 21*f*, 21*g* is larger than the axial length of the first and second center magnets 21*d*, 21*e*. The first and second axial end magnets 21*f*, 21*g* respectively have outer diameters such as 4 mm as same as the outer diameter of the center core 20. Both axial end faces, i.e., magnetic pole faces of the first center magnet 21*d* are inserted between one axial end face of the first center core 20*c* and one axial end face of the second center core 20*d*. Both axial end faces of the second center magnet 21*e* are inserted between the other axial end face of the second center core 20*d* and one axial end face of the third center core 20*e*. One axial end face of the first axial end magnet 21*f* is adjacent to the other axial end face of the first center core 20*c*. One axial end face of the second axial end magnet 21*g* is adjacent to the other axial end face of the third center core 20*e*. The first and second center magnets 21*d*, 21*e*, the first and second axial end magnets 21*f*, 21*g* respectively generate magnetic flux in an opposite direction as a direction, in which the primary coil 25 generates magnetic flux.

The secondary spool 22 is a resinous bottomed cylindrical member that is constructed of a cylindrical portion and a bottom portion. The bottom portion of the secondary spool 22 radially internally extends from one axial end portion of the cylindrical portion.

The center cores 20 axially insert the first and second center magnets 21*d*, 21*e* therein, and both axially outer end portions of the center cores 20 are adjacent to the first and second axial end magnets 21*f*, 21*g*. The center cores 20 are arranged in a space surrounded by the cylindrical portion of the secondary spool 22. An insulating member 28*a* is arranged between the secondary spool 22 and the center cores 20 to insulate therebetween. The secondary coil 23 is a winding wire that is wound on the outer circumferential periphery of the secondary spool 22.

The primary spool 24 is a resinous bottomed cylindrical member that is coaxially arranged on the outer circumferential side of the secondary coil 23. An insulating member 28*b* is arranged between the primary spool 24 and the secondary coil 23 to insulate therebetween. The primary coil 25 is a winding wire that is wound on the outer circumferential periphery of the primary spool 24.

The tube 26 is a resinous cylindrical member that is coaxially arranged on the outer circumferential side of the primary coil 25. The tube 26 protects the primary coil 25, and insulates between the primary coil 25 and the outer circumferential core 27. The outer circumferential core 27 is formed in a manner that a silicon steel plate is rolled to be in a cylindrical member. The outer circumferential core 27 is coaxially arranged on the outer circumferential side of the primary coil 25 that is circumferentially protected by the tube 26.

Next, an operation of the ignition coil 1 is described.

Magnetic flux generated by the primary coil 25 passes from the center cores 20 to the outer circumferential core 27 via the first axial end magnet 21*f*. Subsequently, the magnetic flux passes from the outer circumferential core 27 to the center cores 20 via the second axial end magnet 21*g*.

In this situation, the magnetic flux generated by the primary coil 25 is reverse-biased by axially substantially uniform magnetic flux generated by the first and second center magnets 21*d*, 21*e*, the first and second axial end magnets 21*f*, 21*g* provided to the center cores 20. Thus, the magnetic flux passing through the center cores 20 is further reduced. The magnetic flux generated by the primary coil 25 interlinks the primary coil 25 with the secondary coil 23.

In this structure, magnetic flux passing through the center cores 20 is reverse-biased, however variation of magnetic flux, which induces electric voltage in the secondary coil 23, does not decrease. Therefore, high voltage power can be sufficiently induced in the secondary coil 23.

Figure 10:
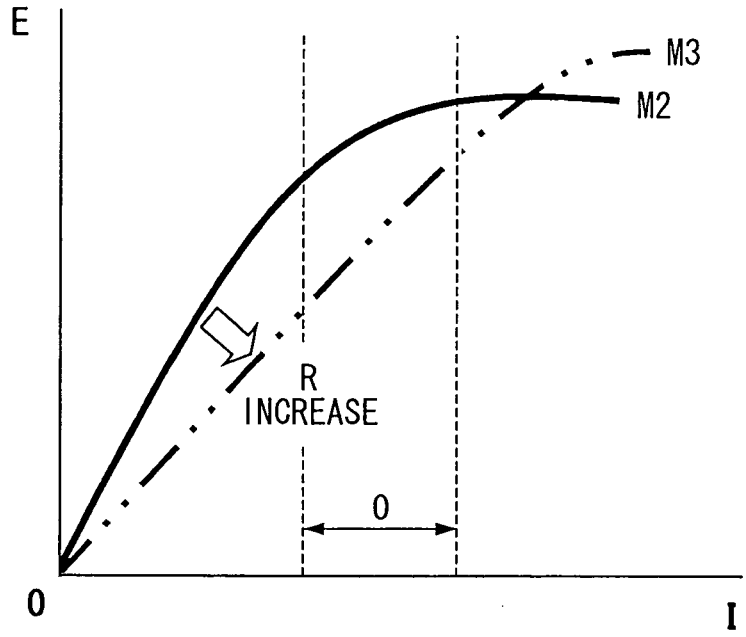
FIG. 10 is a graph showing a relationship between primary current I applied to the ignition coil and secondary energy E generated in the ignition coil, when the number of magnets is changed, according to the third embodiment.

Here, a relationship between primary current I applied to the ignition coil 1 and secondary energy E generated in the ignition coil 1, when the number of magnets is equal to or less than two, is shown by the solid line M2 in FIG. 10. A relationship between primary current I and secondary energy E, when the number of magnets is equal to or greater than three, is shown by the chain double-dashed line M3 in FIG. 10. When primary current I of the ignition coil is on the lower side with respect to an operating range O of the primary current I, as the number of the center magnets becomes large, magnetic resistance R of the center magnets increase. That is, the number of the center magnets increases between two (M2) and three (M3), magnetic resistance R of the center magnet increases as shown by the solid line (M2) and the chain double-dashed line (M3). As a result, secondary energy E of the ignition coil decreases. That is, secondary energy E, which can be supplied to the secondary side in the ignition coil, changes corresponding to the number of the center magnet in the operating range O of the primary current I. The number of the center magnet is preferably two at maximum, as same as this embodiment. When the number of the center magnet is equal to or greater than three, the secondary energy E supplied to the secondary side of the ignition coil decreases in the operating range O of the primary current I of the ignition coil.

Effect of the ignition coil 1 is described in detail.

Magnetic flux generated by the primary coil 25 is reverse-biased by magnetic flux generated by the first and second center magnets 21*d*, 21*e*, the first and second axial end magnets 21*f*, 21*g*, so that the magnetic flux generated by the primary coil 25 can be reverse-biased. In this embodiment, the number of the center magnets, which are arranged in the intermediate portions of the center cores 20, is larger than the number of the center magnet in the ignition coil 1 of the second embodiment. Therefore, magnetic flux passing through the center cores 20 can be further uniformly reverse-biased in the axial direction of the center cores 20. As a result, magnetic flux passing through the center cores 20 can be further reduced, so that magnetic saturation can be avoided even a cross-sectional area of the center cores 20 is reduced. That is, the diameter of the ignition coil 1 can be reduced.

The axial lengths of the first, second and third center cores 20*c*, 20*d*, 20*e* are respectively set to be 60 mm. That is, the distances among the first and second center magnets 21*d*, 21*e*, and the first and second axial end magnets 21*f*, 21*g* are respectively set to be 60 mm. Thus, magnetic flux can be sufficiently reverse-biased, and the axial length of the ignition coil 1 can be reduced.

The axial lengths of the first, second and third center cores 20*c*, 20*d*, 20*e* are not limited to 60 mm. The distances among the first and second center magnets 21*d*, 21*e*, and the first and second axial end magnets 21*f*, 21*g* are preferably set to be equal to or less than 80 mm, as described above. The distances between adjacent magnets are further preferably equal to or less than 60 mm to obtain larger reverse bias.

Here, one axial end magnet can be provided to either of the axial ends of the center cores 20, instead of the above structure in which both first and second axial end magnets 21*f*, 21*g* are provided to both axial end sides of the center cores 20 including the first and second center magnets 21*d*, 21*e* in its intermediate portions. Magnetic. flux can be sufficiently reverse-biased, even in this structure.

Fourth Embodiment

In the above embodiments, each of the permanent magnet 21, the center magnet 21*a*, the first and second magnets 21*d*, 21*e* is formed in a column-shape. However, each of the magnets 21, 21*a*, 21*d*, 21*e* can be formed in a cylindrical shape. In this structure, magnetic resistance of the magnets 21, 21*a*, 21*d*, 21*e* decreases, and secondary energy may be enhanced. Besides, the axial length of the center core 20 can be decreased.

Figure 11A:
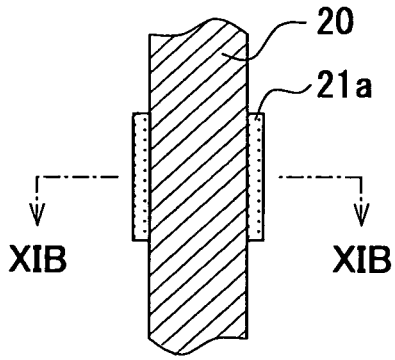
FIG. 11A is a cross-sectional side view showing a center core circumferentially surrounded by a cylindrical magnet.
Figure 11B:
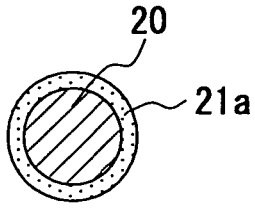
FIG. 11B is a cross-sectional top view showing the center core circumferentially surrounded by the cylindrical magnet along the line XIB—XIB in FIG. 11A according to a fourth embodiment of the present invention.

As shown in FIGS. 11A and 11B, a cylindrical center magnet 21*a* is provided to the center core 20 to circumferentially surround the center core 20. Both axial ends of the cylindrical center magnet 21*a* are magnetized.

Figure 12A:
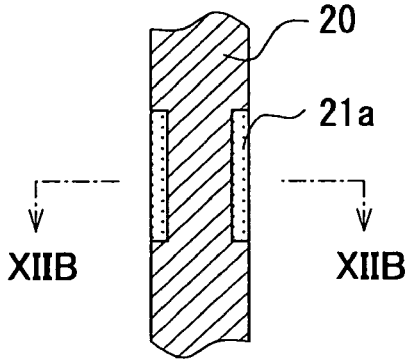
FIG. 12A is a cross-sectional side view showing a center core circumferentially surrounded by a cylindrical magnet that is mounted in the center core.
Figure 12B:
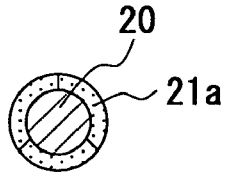
FIG. 12B is a cross-sectional top view showing the center core circumferentially surrounded by the cylindrical magnet along the line XIIB—XIIB in FIG. 12A according to the fourth embodiment.

As shown in FIGS. 12A and 12B, a cylindrical center magnet 21*a*, which is constructed of three pieces of magnets respectively having an arc-shaped axial cross-section, can be provided to the center core 20 to circumferentially surround the center core 20. Both axial ends of each piece of the cylindrical center magnet 21*a* are magnetized. The center core 20 has a circumferential recession in its outer circumferential periphery. The cylindrical center magnet 21*a* is received in the circumferential recession of the center core 20. The center magnet 21*a* can be formed in a manner that a magnetic material, which is made of an elastic material such as rubber, is formed in a cylindrical shape.

Figure 13A:
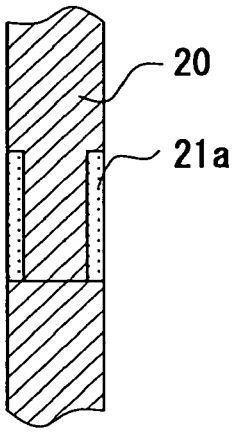
FIG. 13A is a cross-sectional side view showing a center core circumferentially surrounded by the cylindrical magnet that is mounted in the center core divided into two pieces.
Figure 13B:
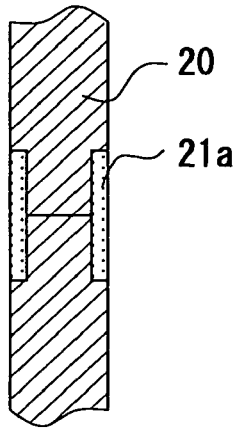
FIG. 13B is a cross-sectional side view showing a center core circumferentially surrounded by the cylindrical magnet that is mounted in the center core divided into two pieces at the axial center.
Figure 13C:
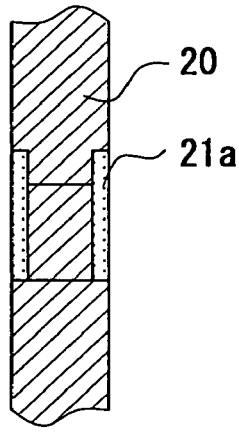
FIG. 13C is a cross-sectional side view showing a center core circumferentially surrounded by the cylindrical magnet that is embedded in the center core divided into three pieces, according to the fourth embodiment.

As shown in FIGS. 13A and 13B, the center core 20 can be axially divided into two pieces at the recession, alternatively, as shown in FIG. 13C, the center core 20 can be axially divided into three pieces at the recession, so that the center magnet 21*a* can be easily assembled to the center core 20.

The axial length of the cylindrical center magnet 21*a* is preferably equal to or greater than the outer diameter of the center core 20. The radial thickness of the cylindrical center magnet 21*a* is preferably equal to or greater than ⅓ of the outer diameter of the center core 20. The above structures can be applied to the structures of the first, second and third embodiments.

The magnets 21, 21*a*, 21*d*, 21*e*, 21*b*, 21*f*, 21*c*, 21*g* are not limited to the column-shaped magnet. The magnets 21, 21*a*, 21*d*, 21*e*, 21*b*, 21*f*, 21*c*, 21*g* can be formed in a manner that multiple magnetic pieces are stacked to be an integrated magnet.

The diameters of the substantially column-shaped center cores 20 are not limited to 4 mm or 8 mm. The diameter of the center cores 20 is preferably equal to or greater than 4 mm, and preferably equal to or smaller than 8 mm. The cross-sectional area of the center core may be determined in accordance with the diameter of the center core. Specifically, the center core 20 can be formed in a manner that multiple rectangular silicon steel plates, which respectively have different widths, are stacked to be in a substantially column shape, which has a cross-sectional shape such as a substantially oval shape, a substantially rectangular shape, and a rhombic shape. The cross-sectional area of the center core is preferably equal to or greater than 12.56 $mm^2$, and preferably equal to or smaller than 50.24 $mm^2$.

The ignition coil 1 is not limited to a vehicular ignition coil that supplies high voltage electric power to an ignition plug of a vehicular internal combustion engine.

Various modifications and alternations may be diversely made to the above embodiments without departing from the spirit of the present invention.

What is claimed is:

1. An ignition coil comprising:

a center core that is made of a magnetic material, the center core defining a magnetic passage;

a primary coil that is coaxially wound on an outer circumferential side of the center core;

a secondary coil that is wound coaxially with respect to the primary coil;

an outer circumferential core that is coaxially arranged on an outer circumferential side of both the primary coil and the secondary coil, the outer circumferential core formed of a magnetic material, the outer circumferential core defining a magnetic passage;

at least one high magnetoresistive member, each high magnetoresistive member arranged between an axially outer end portion of the center core and an axially outer end portion of the outer circumferential core on an axially same side, the high magnetoresistive member having a magnetic resistance higher than both a magnetic resistance of the center core and a magnetic resistance of the outer circumferential core; and at least one permanent magnet, each permanent magnet is located in an axially intermediate portion of the center core such that the permanent magnet is apart from an axially outer end face of the center core by a distance, which is equal to or greater than 20% of an axial length of the center core and is equal to or less than 80% of the axial length of the center core, wherein the at least one permanent magnet generates magnetic flux in a direction that is opposite to a direction, in which the primary coil generates magnetic flux.

2. The ignition coil according to claim 1, wherein the permanent magnet has a thickness, which is equal to or greater than 0.35 mm and is equal to or less than 4 mm in an axis of magnetic poles of the permanent magnet.

3. The ignition coil according to claim 1, wherein the center core has a diameter that is equal to or greater than 4 mm and is equal to or less than 8 mm.

4. The ignition coil according to claim 1, wherein the center core is divided into at least two pieces in an axial direction of the center core.

* * * * *